US005086728A

United States Patent [19]

Kinoshita

[11] Patent Number: 5,086,728

[45] Date of Patent: Feb. 11, 1992

[54] DEVELOPING APPARATUS

[75] Inventor: Masahide Kinoshita, Yokohama, Japan

[73] Assignee: Canon Kabushiki Kaisha, Tokyo, Japan

[21] Appl. No.: 711,875

[22] Filed: Jun. 7, 1991

[30] Foreign Application Priority Data

Aug. 30, 1990 [JP] Japan ..... 2-228919

[51] Int. Cl.[5] ..... G03G 15/08

[52] U.S. Cl. ..... 118/653; 118/661; 355/246; 355/259; 355/260

[58] Field of Search ..... 355/245-246, 355/250, 259, 260; 118/644, 653, 656, 661

[56] References Cited

U.S. PATENT DOCUMENTS

| | | | |
|---|---|---|---|
| 4,458,627 | 7/1984 | Hosono et al. | 118/657 |
| 4,788,570 | 11/1988 | Ogata et al. | 355/245 |
| 4,930,438 | 6/1990 | Demizu et al. | 118/651 |
| 5,016,560 | 5/1991 | Asada et al. | 118/653 |

FOREIGN PATENT DOCUMENTS

| | | | |
|---|---|---|---|
| 42-23910 | 11/1967 | Japan . | |
| 58-116559 | 7/1983 | Japan . | |
| 0169859 | 7/1986 | Japan | 355/245 |
| 2163371 | 2/1986 | United Kingdom | 355/250 |

OTHER PUBLICATIONS

Xerox Disclosure Journal, vol. 2, No. 3, p. 91, May/-Jun. 1977 Masham/Roger D., "Liquid Developer Applicator".

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A developing apparatus is provided with a developer container, a rotatable developer carrying member, a developer regulating member and an elastic rotatable member. Projections and recesses are provided on the surface of the elastic roller for removing a nonmagnetic toner from a developing sleeve and supplying the nonmagnetic toner to the developing sleeve. The number N per unit length of the projections contacting the sleeve in the direction of rotation of the roller, the width d of the nip portion between the sleeve and the roller, the circumferential speed $V_1$ of the sleeve, and the circumferential speed $V_2$ of the roller are set to be:

$V_2 \geqq V_1/4$, and $6 \leqq N \times d \times (V_1 + V_2)/V_1 \leqq 40.$

15 Claims, 4 Drawing Sheets

DEVELOPING APPARATUS

BACKGROUND OF THE INVENTION

1. Field of the Invention

This invention relates to a developing apparatus used for developing into visible form an electrostatic latent image formed on an image bearing member comprising an electrophotographic photosensitive member, an electrostatic recording dielectric member or the like, and more particularly, to a developing apparatus for developing an electrostatic latent image using a dry-type one-component nonmagnetic developer which does not contain carrier particles.

2. Description of the Related Art

In an image forming apparatus, such as a copier, an image recording apparatus, a printer, a facsimile or the like, an electrostatic latent image formed on an image bearing member comprising an electrophotographic photosensitive member, an electrostatic recording dielectric member or the like, is developed by a developing apparatus to render visible the electrostatic latent image as a toner image.

As one type of such developing apparatus, various kinds of developing apparatuses using a dry-type one component non-magnetic developer have been proposed and practically utilized. In order to increase the resolution and sharpness of an image, every developing apparatus must form a thin layer of the one-component nonmagnetic developer (hereinafter termed a toner or a nonmagnetic toner since the developer does not contain carrier particles) on a developer carrying member.

For example, as shown in U.S. Pat. No. 4,458,627, by contacting an elastic blade made of rubber or metal to a developing sleeve of a developer carrying member, and regulating by passing toner particles through a contact portion (nip portion) between the elastic blade and the developing sleeve, a thin layer of toner particles is formed on the developing sleeve, and sufficient triboelectric charges are provided on the toner particles due to friction at the contacting portion.

Of course, before regulating the thickness of the layer of nonmagnetic toner particles on the developing sleeve, the nonmagnetic toner particles must be supplied and coated on the developing sleeve.

In Japanese Patent Application Public Disclosure (Kokai) No. 58-116559 (1983), the apparatus shown in FIG. 1 is described. In this developing apparatus, an elastic roller 15 having a fur-brush structure contacting a developing sleeve 3 at a position upstream from an elastic blade 4 in the direction of rotation of the developing sleeve 3 is provided within a developing container 2 receiving a nonmagnetic toner 6, serving as a one-component developer. Particles of the toner 6 remaining on the developing sleeve 3 not consumed in development are removed by the elastic roller 15, and new particles of the toner 6 are supplied and coated on the developing sleeve 3.

In U.S. Pat. No. 4,930,438, a sponge roller, serving as an elastic roller, is described which contacts a developing sleeve and rotates in the same direction as the developing sleeve, and supplies and coats nonmagnetic toner particles on the developing sleeve.

However, when it is impossible to sufficiently remove toner particles remaining on the sleeve after passing a developing area, and to supply and coat an appropriate amount of toner particles on the sleeve by the brush roller or the sponge roller in the prior art, an excellent image cannot be obtained.

Particularly, toner particles having a small particle size (i.e., having a volume average particle size of 5–8 μm) capable of forming an image having a high picture quality are not effectively removed from the sleeve.

That is, toner particles having a small particle size have larger surface areas per unit volume than toner particles having a normal particle size (having a volume average particle size of about 10–12 μm). Toner particles having a small particle size also have a higher probability of friction with the developing sleeve 3. As a result, triboelectric charges supplied to toner particles having a small particle size tend to be relatively higher. Accordingly, toner particles having a small particle size have a large electrostatic adhesion force with respect to the developing sleeve, and so the removal of toner particles remaining on the developing sleeve not consumed in development tends to be insufficient.

The toner particles remaining on the developing sleeve are mixed with toner particles newly supplied onto the developing sleeve, are sent to the contact portion between the developing sleeve and the elastic blade, and are subjected to triboelectric charging with the sleeve together with the newly supplied toner particles. At that time, while the newly supplied toner particles are provided with proper electric charges by triboelectric charging, the remaining toner particles are excessively charged since they are subjected to repeated triboelectric charging. The excessively charged toner particles have a greater electrostatic adhesion force with respect to the sleeve than the toner particles provided with proper electric charges, and so those particles have difficulty in being used for development. As a result, an image obtained by development causes unevenness in density as a whole. Particularly, in a so-called non-contact-type developing apparatus, wherein the thickness of the layer of toner particles is smaller than a gap between a developing sleeve and an image bearing member at a developing area, and toner particles are flown toward the image bearing member, the above-described unevenness in density is more pronounced.

As an example, if an copying operation is performed using an original (having reflective densities of 1.5, 0.3 and 0.05 on image portions at portions S, P and Q, respectively, length l corresponding to one circumference of the developing sleeve, and direction G of development), as shown in FIG. 2A, when the removal of toner particles remaining on the developing sleeve not consumed in development by the elastic roller is insufficient, a copied image of the original becomes as shown in FIG. 2B.

That is, while toner particles on a region corresponding to portion S on the developing sleeve are consumed by the development of portion Sa, which is an image corresponding to portion S of the original, at the first revolution of the developing sleeve, toner particles remain on the sleeve without being consumed on the other regions. The toner particles on the other regions are not sufficiently removed from the sleeve by the elastic roller. Hence, in a developed image at the second revolution of the sleeve, portion Pb has a density corresponding to the density of portion P of the original, but the density of portion Pa other than portion Pb is low. That is, portion Pb looks like a ghost of portion Sa. Accordingly, the above-described phenomenon will be hereinafter termed a ghost phenomenon. Such a ghost phenomenon cannot be prevented even by applying an oscillating bias voltage for increasing the development efficiency to the sleeve.

In order to solve the above-described problems, such as uneven density and the like, it is necessary to increase the removing capability of the elastic roller for toner particles remaining on the developing sleeve.

On the other hand, if, for example, an entirely black image is developed when the supply of new toner particles onto the developing sleeve by the elastic roller is insufficient, a phenomenon occurs wherein the density of image portions developed at the second or later revolution of the developing sleeve becomes smaller than the density of image portions developed at the first revolution of the developing sleeve. FIG. 3 shows how the densitites of such images look like.

In FIG. 3, copied images are obtained by being developed in the direction of arrow G, and length l corresponds to one circumference of the developing sleeve. A portion corresponding to the first revolution of the developing sleeve has the greatest density, and densities become smaller according to the order after the second revolution. This phenomenon is caused by the fact that the amount of toner particles supplied by the elastic roller after the second revolution is smaller than the amount of toner particles consumed in development at the first revolution of the developing sleeve. This phenomenon will be hereinafter termed a density diminishing phenomenon.

Particularly, since the above-described toner particles having a small particle size have poorer flowability than toner particles having a normal particle size, the supply of the toner particles having a small particle size to the developing sleeve tends to be insufficient. Accordingly, sufficient attention must also be paid to the toner supply capability of the elastic roller.

SUMMARY OF THE INVENTION

It is an object of the present invention to provide a developing apparatus which can obtain an excellent image using a one-component nonmagnetic developer.

It is a further object of the present invention to provide a developing apparatus using a one-component nonmagnetic developer which can prevent a ghost phenomenon.

It is a still further object of the present invention to provide a developing apparatus using a one-component nonmagnetic developer which can prevent a density diminishing phenomenon.

It is still another object of the present invention to provide a developing apparatus which can form an excellent developed image while preventing a ghost phenomenon and a density diminishing phenomenon even if toner particles having a small particle size are used.

In the present invention, an elastic rotatable member forming a nip portion with a developer carrying member is provided within a container for supplying a rotatable developer carrying member with a one-component nonmagnetic developer. The elastic rotatable member has a surface having projections and recesses thereon. A foam member on the surface of which cells and cell walls are exposed is preferred for the elastic rotatable member. In any case, the elastic rotatable member rotates in the same direction as the developer carrying member. Accordingly, the surface of the rotatable developer carrying member and the surface of the elastic rotatable member move in the directions reverse to each other at the nip portion. Thus, the elastic rotatable member removes toner particles which have not been consumed in development from the developer carrying member, and coats fresh toner particles on the developer carrying member.

In the present invention, in order to prevent the ghost phenomenon and the density diminishing phenomenon, the circumferential speed $V_1$ (mm/sec) of the developer carrying member, the circumferential speed $V_2$ (mm/sec) of the elastic rotatable member, the width d (mm) of the nip portion between the developer carrying member and the elastic rotatable member, and the number N (/mm) per unit length of the projections on the surface of the elastic rotatable member in the direction of rotation of the elastic rotatable member are set so as to satisfy the relationship:

$$V_2 \geqq V_1/4,$$

$$6 \leqq N \times d \times (V_1 \times V_2)/V_1 \leqq 40.$$

These and other objects and advantages of the present invention will become more apparent from the following description thereof.

DETAILED DESCRIPTION OF THE PREFERRED EMBODIMENTS

Figure 1:
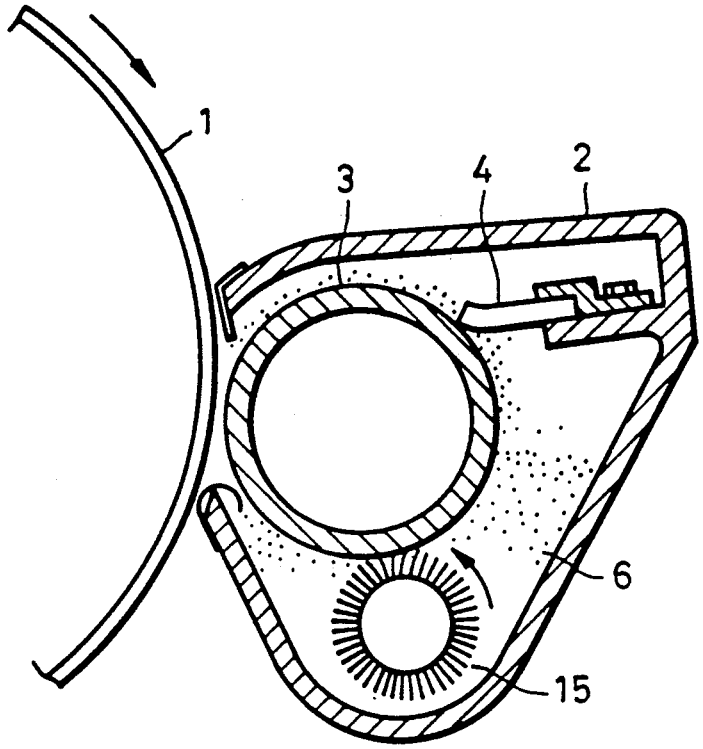
FIG. 1 (PRIOR ART)
FIG. 1 is a diagram illustrating a conventional apparatus.
Figure 2A:
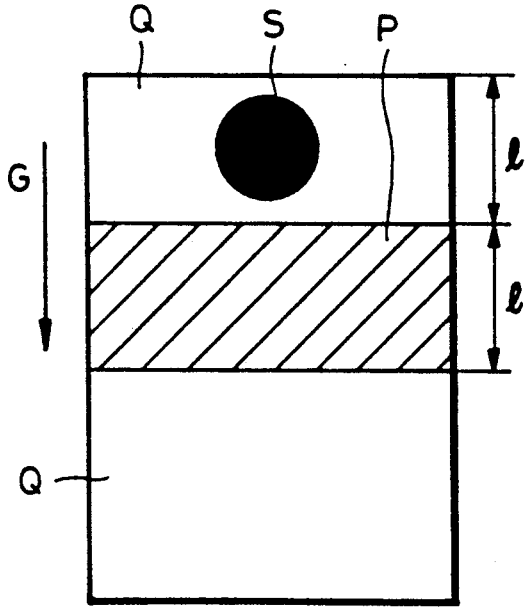
FIG. 2A is a diagram illustrating an original to be copied.
Figure 2B:
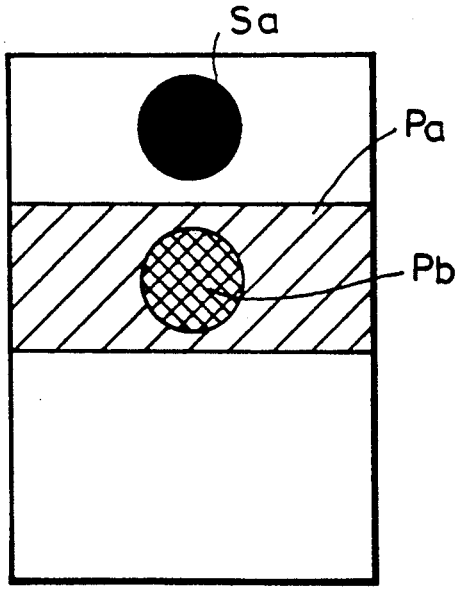
FIG. 2B (PRIOR ART)
FIG. 2B is a diagram illustrating a developed image by the conventional apparatus.
Figure 3:
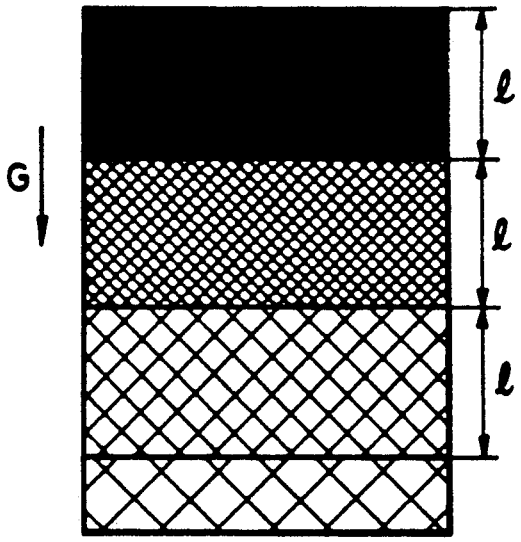
FIG. 3 (PRIOR ART)
FIG. 3 is a diagram illustrating another developed image by the conventional apparatus.
Figure 4:
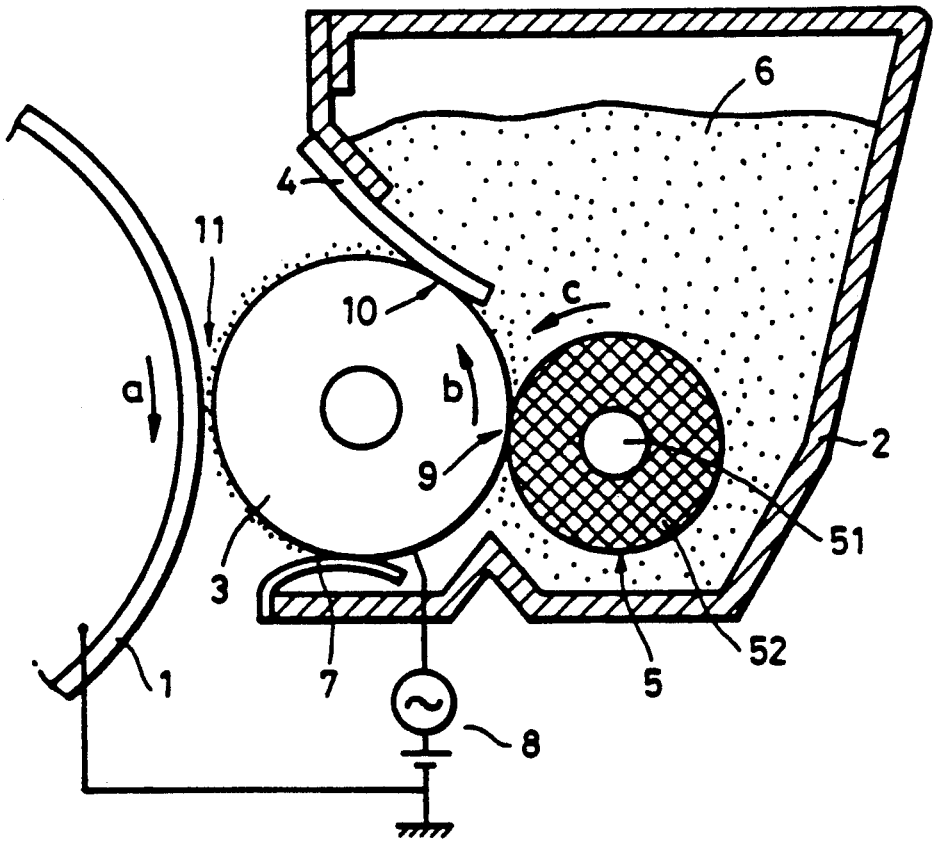
FIG. 4 is a diagram illustrating an embodiment of the present invention.

FIG. 4 shows a developing apparatus according to an embodiment of the present invention.

In FIG. 4, a container 2 receives a nonmagnetic toner 6, serving as a dry-type one-component developer. It is preferred that silica fine particles are added to the toner 6 in order to increase the flowability and triboelectric charging characteristics of the toner 6. The developing apparatus includes an electrophotographic photosensitive member 1 rotating in the direction of arrow "a" and a developing sleeve 3 facing the photosensitive member 1 at a developing area. An electrostatic latent image on the photosensitive member 1 is developed and thereby visualized as a toner image.

For the image carrying member 1, for example, a so-called xerographic photosensitive member which forms an electrostatic latent image using a Carlson process, a photosensitive member having an insulating layer on a surface on which an electrostatic latent image is formed using an NP process described in Japanese Patent Application Publication No. 42-23910 (1967), an insulating member for forming an electrostatic latent image using an electrostatic recording method, an insulating member for forming an electrostatic latent image using a transfer method, and any other member for forming an electrostatic latent image (including a latent image in electric potential) by an appropriate method may be used.

The container 2 has an opening extending in the longitudinal direction (the direction perpendicular to the plane of FIG. 4) of the developing apparatus. The developing sleeve 3 is provided in the opening.

The developing sleeve 3 is made of a material, such as aluminum, stainless steel or the like. The developing sleeve 3 is disposed so that its right-side nearly semicircular surface is positioned within the container 2 contacting the opening, and its left-side nearly semicircular surface is exposed to the outside so as to face the photosensitive member 1. A small gap is provided between the developing sleeve 3 and the photosensitive member 1. The developing sleeve 3 is rotatably driven in the direction of arrow b.

A developer carrying member is not limited to a cylinder as the above-described developer sleeve 3, but may also have the shape of a rotatably driven endless belt. Alternatively, a conductive rubber roller may be used.

An elastic blade 4, serving as a developer regulating member, is also provided in the container 2. In addition, an elastic roller 5 is provided within the container 2 at a position upstream from the elastic blade 4 in the direction of rotation of the developing sleeve 3.

The elastic blade 4 is obliquely provided so as to hang down toward the upstream side in the direction of rotation of the developing sleeve 3, and elastically contacts the upper circumferential surface of the developing sleeve 3 at a nip portion 10.

The elastic roller 5 elastically contacts the developing sleeve 3 at a nip portion 9 within the container 2, and is supported substantially parallel to the developing sleeve 3.

The elastic roller 5 rotates in the direction of arrow c which is the same direction as the direction b of rotation of the developing sleeve 3, whereby particles of the toner 6 within the container 2 are carried and conveyed toward the developing sleeve 3. At the contact portion (nip portion) 9 between the developing sleeve 3 and the elastic roller 5, particles of the toner 6 on the elastic roller 5 are triboelectrically charged by being rubbed with the developing sleeve 3, and electrostatically adhere to the surface of the developing sleeve 3.

Subsequently, in accordance with the rotation of the developing sleeve 3, particles of the toner 6 adhered to the surface of the developing sleeve 3 penetrate in the contact portion (nip portion) 10 between the elastic blade 4 and the developing sleeve 3 for forming a thin layer of toner particles, and are subjected to sufficient triboelectric charging to a polarity for developing the electrostatic latent image by being rubbed with both the surface of the developing sleeve 3 and the elastic blade 4 when passing through the contact portion 10.

The particles of the toner 6 charged as described above leave the contact portion 10 between the elastic blade 4 and the developing sleeve 3 to form a thin layer on the developing sleeve 3, and are conveyed to a developing area 11 where the developing sleeve 3 faces the photosensitive member 1 with providing a small gap. By applying an oscillating voltage, serving as a developing bias voltage, obtained by superposing an AC voltage with a DC voltage from a power supply 8 to the developing sleeve 3, particles of the toner 6 on the developing sleeve 3 are transferred to the photosensitive member 1 in accordance with the electrostatic latent image at the developing area 11, and adhere to the electrostatic latent image to form a toner image. Since the thickness of the toner-particle layer regulated by the elastic blade 4 is smaller than the above-described gap, particles of the toner 6 fly from the developing sleeve 3 and adhere to the photosensitive member 1.

Particles of the toner 6 remaining on the developing sleeve 3 not being consumed in the development at the developing region 11 are collected within the container 2 from the lower portion of the developing sleeve 3 in accordance with the rotation of the developing sleeve 3.

A seal member 7 is provided in a toner collecting portion of the container 2. The seal member 7 permits particles of the toner 6 remaining on the developing sleeve 3 to pass within the container 2, and prevents particles of the toner 6 within the container 2 from leaving from the lower portion of the container 2.

The particles of the toner 6 collected within the container 2 are removed from the developing sleeve 3 at the contact portion (nip portion) 9 due to friction by the rotating elastic member 5. At the same time, as described above, new particles of the toner 6 are supplied onto the developing sleeve 3 due to the rotation of the elastic roller 5.

On the other hand, most of the removed particles of the toner 6 are conveyed and mixed with particles of the toner 6 within the developing container 2 in accordance with the rotation of the elastic roller 5, and electric charges on the removed particles of the toner 6 are dispersed.

An appropriately rough surface is formed on the surface of the developing sleeve 3, whereby the probability of friction between the surface of the developing sleeve 3 and particles of the toner 6 is increased, and the conveying property of the toner 6 is also increased.

The rough surface is obtained by performing sandblast processing on the surface of the developing sleeve 3 using irregular Alundum abrasive grains or spherical glass beads so that the average surface roughness Rz of ten points provided in JIS (Japanese Industrial Standards) B-0601 becomes 1-10 μm. Alternatively, the rough surface may be provided on the surface of the developing sleeve 3 by providing a resin surface layer obtained by dispersing fine particles of metal oxides or conductive fine particles of graphite, carbon or the like within a binder resin, such as phenol resin, fluroresin or the like.

In the present embodiment, an aluminum sleeve having a diameter of 16 mm was used for the developing sleeve 3, on the surface of which sandblast processing was performed using spherical glass beads (#600) to provide a surface roughness Rz of about 4 μm.

The elastic blade 4 comprises an elastic member made of a rubber member (having a hardness provided in JIS A of 40°-90°), such as silicon rubber, urethane rubber or the like, or a metal thin plate spring made of phosphor blonze, stainless steel or the like. Part of the surface of the elastic blade 4 facing the developing sleeve 3 elastically contacts the developing sleeve 3 in surface contact.

The contact pressure per centimeter of the elastic blade 4 to the developing sleeve 3 in the direction of the generatrix of the developing sleeve 3 is preferably 5-200 g/cm. In the present embodiment, a blade made of urethane rubber 1 mm thick having a hardness of 73° was used as the elastic blade 4, which was contacted to the developing sleeve 3 with a pressure of 50 g/cm.

The nonmagnetic toner 6 comprises a pigment, such as carbon or the like, dispersed in various kinds of thermoplastic resin, such as styrene resin, acrylic resin, polyethylene resin or the like. In the present embodiment, a toner powder having a volume average particle size of 8 μm comprising a copolymer of styrene-acrylic resin and styrene-butadiene resin, and a pigment with 1.0% of colloidal silica fine particles added thereto was used as the toner 6.

A detailed explanation will now be provided of the elastic roller 5.

As described above, the elastic roller 5 has the two functions of removing particles of the toner 6 remaining on the developing sleeve 3 and supplying new particles of the toner 6 to the developing sleeve 3.

As the elastic roller 5, a roller comprising a foam rubber elastic member 52, made of polyurethane foam which is continuously-porous sponge rubber, silicone rubber sponge which is an independently-porous sponge rubber, or the like, surrounding a metal core 51 is preferred.

Figure 5:
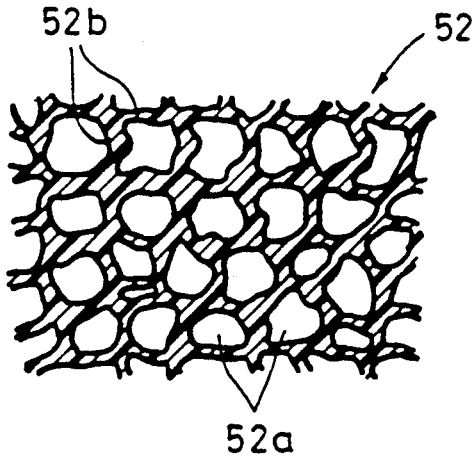
FIG. 5 is an enlarged view of the surface of an elastic roller.

FIG. 5 is an enlarged view of the surface of the foam elastic roller 5 in contact with the developing sleeve 3, that is, the outer circumferential surface of the elastic roller 5.

As shown in FIG. 5, the foam member 52 of the elastic roller 5 has the structure in which cells (form portions) **52*a* are surrounded with cell walls 52*b*. The cells 52*a* and the cell walls 52*b* are exposed on the surface of the elastic roller 5** as recesses and projections, respectively.

In accordance with the rotation of the above-described elastic roller 5, mainly portions directed in the longitudinal direction (axial direction) of the elastic roller 5 among the two-dimensionally continuing cell walls **52*b* rub the developing sleeve 3, and remove particles of the toner 6 remaining on the developing sleeve 3. The removed particles of the toner 6 are held and conveyed within the cells 52*a*, and are mixed with particles of the toner 6 received within the container 2. Fresh particles of the toner 6 within the container 2 are held and conveyed within the cells 52*a*, and supplied to the developing sleeve 3**.

According to an experiment by the inventor of the present invention, it has become clear that, in order to stably perform the removal of particles of the toner 6 remaining on the developing sleeve 3 by the elastic roller 5, and the supply and coating of new particles of the toner 6 onto the developing sleeve 3, portions of the cell walls **52*b* of the foam elastic member 52 directed in the longitudinal direction of the elastic roller 5 play an important part. If the elastic roller 5 has a configuration in which the cell walls 52*b* are not present, or a configuration in which the surface layer comprises a smooth skin layer made of urethane rubber, the elastic roller 5 provides a predetermined performance at the initial stage of the use. However, if the developing operation is repeated, the rubbing function for particles of the toner 6 on the developing sleeve 3 becomes too strong, causing the fusion of particles of the toner 6 on the developing sleeve 3. Such a phenomenon is not preferable. Furthermore, since the pressure exerted on particles of the toner 6 is too strong, the deterioration of particles of the toner 6** is accelerated.

On the contrary, if the elastic roller 5 provided with the foam member 52 having the configuration of recesses and projections comprising the cells **52*a* and the cell walls 52*b* along the circumferential direction of the roller 5 is used, it is possible to stably perform the removal of particles of the toner 6 remaining on the developing sleeve 3, and the supply of new particles of the toner 6 to the developing sleeve 3** in conditions to be described later.

The direction c of rotation of the elastic roller 5 is preferred to be the same direction as the direction b of rotation of the developing sleeve 3.

If the elastic roller 5 and the developing sleeve 3 are rotated in the opposite direction to each other, the surfaces of the two members move in the same direction at the nip portion. Hence, the elastic roller 5 cannot sufficiently supply particles of the toner 6 onto the developing sleeve 3, and cannot sufficiently remove particles of the toner 6 from the developing sleeve 3. Such phenomena are not preferable.

Figure 6:
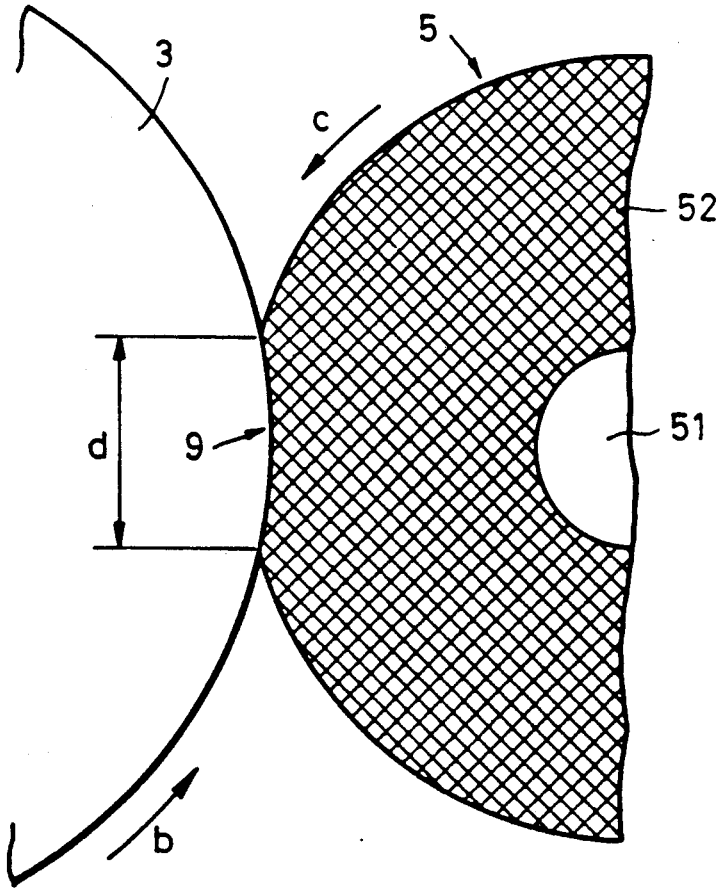
FIG. 6 is an enlarged view of a nip portion.

According to another experiment by the inventor of the present invention, it has become clear that portions directed in the longitudinal direction of the elastic roller 5 among the cell walls **52*b* of the foam member 52, the contact width (nip width) d between the elastic roller 5 and the developing sleeve 3 shown in FIG. 6, and the relative circumferential speed of the elastic roller 5 with respect to the developing sleeve 3 are factors strongly influencing the removal of particles of the toner 6 remaining on the developing sleeve 3 by the elastic roller 5, and the supply and coating of new particles of the toner 6 onto the developing sleeve 3 (the nip width d indicates the length of the nip portion in the direction of rotation of the developing sleeve 3, i.e., in the direction of rotation of the elastic roller 5**).

In order to find out optimum conditions for the above-described factors, a roller having an outer diameter of 14 mm comprising the foam rubber member 52 made of polyurethane foam (product name: moltopren, made by INDAC Corp.), which is a continuously-porous rubber, coated on the metal core member 51 having an outer diameter of 5 mm was used as the elastic roller 5. Copying operations were performed with changing the circumferential speed $v_2$ (mm/sec) of the elastic roller 5, the contact width (nip width) d (mm) between the elastic member 5 and the developing sleeve 3, and the number N/mm per unit length of the cell walls **52*b* of the foam member 52 in the circumferential direction (the direction of rotation) of the elastic roller 5** in various ways. The above-described density diminishing phenomenon and ghost phenomenon were checked, and deterioration in picture quality after performing continuous copying operations for 2000 sheets was also checked.

A copier of type FC5 made by Canon Inc. was used, in which the developing apparatus shown in FIG. 4 using the above-described elastic roller 5 was incorporated.

The above-described deterioration in picture quality after continuous copying operations for a large number of sheets occurs when the removing and supplying capability of the elastic roller 5 for particles of the toner 6 is excessively increased.

That is, if toner particles are damaged due to a mechanical external force, the charging capability of the toner particles decreases, and thus the particles cannot be subjected to proper triboelectric charging. As a result, the damaged toner particles are not consumed in development, and are gradually accumulated within the container 2 while repeating the copying operation. If the ratio of damaged toner particles within the container 2 increases, the probability of friction between damaged toner particles and normal toner particles increases. As a result, so-called positive fog is produced wherein the number of toner particles charged to a reverse polarity to the desired polarity for developing a latent image increases, and such toner particles adhere to areas not having images on the photosensitive member 1.

The contents of the deterioration in picture quality after continuous copying operations for a large number of sheets have now been described.

The experimental conditions are as follows: As for the surface potential of an electrostatic latent image on the photosensitive member 1, dark-portion potential was −600 V (volts), and light-portion potential was −150 V. The gap between the photosensitive member 1 and the developing sleeve 3 was 250 μm. The developing bias voltage applied between the photosensitive member 1 and the developing sleeve 3 was a DC voltage of −250 V superposed with an AC voltage having a frequency of 1800 Hz (hertz) and a peak-to-peak voltage of 1200 V. The circumferential speed (process speed) of the photosensitive member 1 was about 50 mm/sec, and the circumferential speed $v_1$ of the developing sleeve 3 was 70 mm/sec.

Results shown in Tables 1–3 were obtained in experiments in the above-described conditions. In each table, mark ○ indicates that the result was excellent, and mark × indicates that the result was bad.

TABLE 1

| the number N of cell walls = 1(/mm) | | | | | | | | | |
|---|---|---|---|---|---|---|---|---|---|
| | d = 1 mm | | | d = 2 mm | | | d = 3 mm | | |
| | Ghost | Density diminishing | Deterioration in picture quality | Ghost | Density diminishing | Deterioration in picture quality | Ghost | Density diminishing | Deterioration in picture quality |
| v2 = (¼)v1 | × | × | ○ | × | × | ○ | × | × | ○ |
| v2 = (½)v1 | × | × | ○ | × | × | ○ | × | × | ○ |
| v2 = (¾)v1 | × | × | ○ | × | × | ○ | × | ○ | ○ |
| v2 = v1 | × | × | ○ | × | × | ○ | ○ | ○ | ○ |
| v2 = 2v1 | × | × | ○ | ○ | ○ | ○ | ○ | ○ | ○ |
| v2 = 3v1 | × | × | ○ | ○ | ○ | ○ | ○ | ○ | ○ |
| v2 = 4v1 | × | × | ○ | ○ | ○ | ○ | ○ | ○ | ○ |
| v2 = 5v1 | ○ | ○ | ○ | ○ | ○ | ○ | ○ | ○ | ○ |

| | d = 4 mm | | | d = 8 mm | | |
|---|---|---|---|---|---|---|
| | Ghost | Density diminishing | Deterioration in picture quality | Ghost | Density diminishing | Deterioration in picture quality |
| v2 = (¼)v1 | × | ○ | ○ | ○ | ○ | ○ |
| v2 = (½)v1 | ○ | ○ | ○ | ○ | ○ | ○ |
| v2 = (¾)v1 | ○ | ○ | ○ | ○ | ○ | ○ |
| v2 = v1 | ○ | ○ | ○ | ○ | ○ | ○ |
| v2 = 2v1 | ○ | ○ | ○ | ○ | ○ | ○ |
| v2 = 3v1 | ○ | ○ | ○ | ○ | ○ | ○ |
| v2 = 4v1 | ○ | ○ | ○ | ○ | ○ | ○ |
| v2 = 5v1 | ○ | ○ | ○ | ○ | ○ | × |

TABLE 2

| the number N of cell walls = 2(/mm) | | | | | | | | | |
|---|---|---|---|---|---|---|---|---|---|
| | d = 1 mm | | | d = 2 mm | | | d = 3 mm | | |
| | Ghost | Density diminishing | Deterioration in picture quality | Ghost | Density diminishing | Deterioration in picture quality | Ghost | Density diminishing | Deterioration in picture quality |
| v2 = (¼)v1 | × | × | ○ | × | ○ | ○ | ○ | ○ | ○ |
| v2 = (½)v1 | × | × | ○ | ○ | ○ | ○ | ○ | ○ | ○ |
| v2 = (¾)v1 | × | × | ○ | ○ | ○ | ○ | ○ | ○ | ○ |
| v2 = v1 | × | × | ○ | ○ | ○ | ○ | ○ | ○ | ○ |
| v2 = 2v1 | ○ | ○ | ○ | ○ | ○ | ○ | ○ | ○ | ○ |
| v2 = 3v1 | ○ | ○ | ○ | ○ | ○ | ○ | ○ | ○ | ○ |

TABLE 2-continued

| | the number N of cell walls = 2(/mm) | | | | | | | | |
|---|---|---|---|---|---|---|---|---|---|
| v2 = 4v1 | ○ | ○ | ○ | ○ | ○ | ○ | ○ | ○ | ○ |
| v2 = 5v1 | ○ | ○ | ○ | ○ | ○ | ○ | ○ | ○ | ○ |

| | d = 4 mm | | | d = 8 mm | | |
|---|---|---|---|---|---|---|
| | Ghost | Density diminishing | Deterioration in picture quality | Ghost | Density diminishing | Deterioration in picture quality |
| v2 = (1/4)v1 | ○ | ○ | ○ | ○ | ○ | ○ |
| v2 = (1/3)v1 | ○ | ○ | ○ | ○ | ○ | ○ |
| v2 = (2/3)v1 | ○ | ○ | ○ | ○ | ○ | ○ |
| v2 = v1 | ○ | ○ | ○ | ○ | ○ | ○ |
| v2 = 2v1 | ○ | ○ | ○ | ○ | ○ | × |
| v2 = 3v1 | ○ | ○ | ○ | ○ | ○ | × |
| v2 = 4v1 | ○ | ○ | ○ | ○ | ○ | × |
| v2 = 5v1 | ○ | ○ | × | ○ | ○ | × |

TABLE 3

| | the number N of cell walls = 3(/mm) | | | | | | | | |
|---|---|---|---|---|---|---|---|---|---|
| | d = 1 mm | | | d = 2 mm | | | d = 3 mm | | |
| | Ghost | Density diminishing | Deterioration in picture quality | Ghost | Density diminishing | Deterioration in picture quality | Ghost | Density diminishing | Deterioration in picture quality |
| v2 = (1/4)v1 | × | × | ○ | ○ | ○ | ○ | ○ | ○ | ○ |
| v2 = (1/3)v1 | × | × | ○ | ○ | ○ | ○ | ○ | ○ | ○ |
| v2 = (2/3)v1 | × | ○ | ○ | ○ | ○ | ○ | ○ | ○ | ○ |
| v2 = v1 | ○ | ○ | ○ | ○ | ○ | ○ | ○ | ○ | ○ |
| v2 = 2v1 | ○ | ○ | ○ | ○ | ○ | ○ | ○ | ○ | ○ |
| v2 = 3v1 | ○ | ○ | ○ | ○ | ○ | ○ | ○ | ○ | ○ |
| v2 = 4v1 | ○ | ○ | ○ | ○ | ○ | ○ | ○ | ○ | ○ |
| v2 = 5v1 | ○ | ○ | ○ | ○ | ○ | ○ | ○ | ○ | × |

| | d = 4 mm | | | d = 8 mm | | |
|---|---|---|---|---|---|---|
| | Ghost | Density diminishing | Deterioration in picture quality | Ghost | Density diminishing | Deterioration in picture quality |
| v2 = (1/4)v1 | ○ | ○ | ○ | ○ | ○ | ○ |
| v2 = (1/3)v1 | ○ | ○ | ○ | ○ | ○ | ○ |
| v2 = (2/3)v1 | ○ | ○ | ○ | ○ | ○ | ○ |
| v2 = v1 | ○ | ○ | ○ | ○ | ○ | × |
| v2 = 2v1 | ○ | ○ | ○ | ○ | ○ | × |
| v2 = 3v1 | ○ | ○ | × | ○ | ○ | × |
| v2 = 4v1 | ○ | ○ | × | ○ | ○ | × |
| v2 = 5v1 | ○ | ○ | × | ○ | ○ | × |

Table 1 shows a case wherein the number N of cell walls per unit length on the surface of the elastic roller 5 in the circumferential direction of the roller is 1/mm (the density of the foam member 52 is 30±5 kg/m$^3$). Table 2 shows a case wherein the number N is 2/mm (the density of the foam member 52 is 30±5 kg/m$^3$). Table 3 shows a case wherein the number N is 3/mm (the density of the foam member is 80±5 kg/m$^3$).

From Table 1, it has become clear that, when using the elastic roller 5 wherein the number of cell walls per 1 mm in the circumferential direction of the roller is 1, in order to prevent the generation of ghosts in a copied image, and also prevent the density diminishing phenomenon, the relationship between the circumferential speed $v_2$ of the elastic roller 5 and the circumferential speed $v_1$ of the developing sleeve 3 may be $v_2 \geqq 5\ v_1$ when the contact width (nip width) d between the elastic roller 5 and the developing sleeve 5 is 1 mm, $v_2 \geqq 2\ v_1$ when the contact width d is 2 mm, and $v_2 \geqq v_1/2$ when the contact width d is 4 mm. According to this conclusion, the density diminishing phenomenon can also be prevented in the condition for preventing at least the generation of ghosts.

When the circumferential speed of the elastic roller 5 is 0, toner particles are not supplied to the developing sleeve 3. This is not preferable. Furthermore, if $v_2 \geqq 5\ v_1$ when the contact width d is 8 mm, deterioration in picture quality due to continuous copying operations for a large number of sheets occurred.

If attention is paid on the distance d $(v_1+v_2)/v_1$ through which an arbitrary point on the developing sleeve 3 is rubbed with cell walls of the elastic roller 5 parallel to the axis during the time period that the arbitrary point passes through the contact portion (nip portion) 9 between the developing sleeve 3 and the elastic roller 5, it can be understood from Table 1 that, when using the elastic roller 5 wherein the number of cell walls per 1 mm in the circumferential direction of the roller is 1, a developed image having an excellent picture quality is obtained in the condition of $$6 \leqq d(v_1+v_2)/v_1 \leqq 40,$$

when $v_2 \geqq v_1/4$.

Similarly, from Table 2, it can be understood that, when using the elastic roller 5 wherein the number of cell walls per 1 mm in the circumferential direction of the roller is 2, a developed image having an excellent picture quality is obtained in the condition of $$3 \leqq d(v_1+v_2)/v_1 \leqq 20,$$

when $v_2 \geqq v_1/4$. From Table 3, it can be understood that, when using the elastic roller 5 wherein the number of cell walls per 1 mm in the circumferential direction of the roller is 3, a developed image having an excellent picture quality is obtained in the condition of $$2 \leqq d(v_1+v_2)/v_1 \leqq 14,$$

when $v_2 \geqq v_1/4$.

Accordingly, from the results shown in Tables 1-3, it has become clear that, when $v_2 \geqq v_1/4$, if the number N of cell walls with which an arbitrary point on the developing sleeve 3 is rubbed within the time period that the arbitrary point passes through the contact portion (nip portion) 9 between the developing sleeve 3 and the elastic roller 5 satisfies the following conditional expression (1), that is, $$6 \leqq N \times d \times (v_1+v_2)/v_1 \leqq 40 \qquad (1),$$

the removal of particles of the toner 6 remaining on the developing sleeve 3 and the supply of new particles of the toner 6 to the developing sleeve 3 can be stably performed, and an excellent image not having deterioration in picture quality can be obtained (the number N/mm of cell walls is the number per unit length of cell walls contacting the developing sleeve 3 in the circumferential direction of the roller).

The result of check on the durability of the elastic roller 5 during continuous copying operations for a large number of sheets indicates that, if the contact width d between the elastic roller 5 and the developing sleeve 3 was made to be less than 8 mm, no problems occurred even if continuous copying operations for 2000 sheets were performed. However, if the contact width d was increased from 8 mm, the elastic roller 5 itself was damaged. This result is not preferable. If the contact width d was less than 1 mm, the contact of the elastic roller 5 with the developing sleeve 3 having a stable pressure distribution could not be obtained during rotatable drive. This result is not preferable.

In a similar experiment performed by setting the circumferential speed $v_1$ of the developing sleeve 3 to 100 mm/sec in order to check the appropriateness of the above-described conditional expression (1), an excellent image was obtained within the range satisfying the conditional expression (1).

In conclusion, when the condition $$6 \leqq N \times d \times (v_1+v_2)/v_1 \leqq 40$$

was satisfied with the contact width d of 1 mm $\leqq$ d $\leqq$ 8 mm within the range of the circumferential speed $v_2$ of the elastic roller 5 of $v_2 \geqq v_1/4$, the removal of particles of the toner 6 remaining on the developing sleeve 3 and the supply of new particles of the toner 6 to the developing sleeve 3 could be stably performed, and an excellent toner image not having deterioration in picture quality which does not have ghosts and faithfully reproduces an entirely black original was obtained.

While the present invention is particularly useful for an apparatus using toner particles having a volume average particle size of 5-8 μm, an excellent image was also obtained when the conditional expression (1) was satisfied even if a toner having a volume average particle size of greater than 8 μm, for example, a toner having a normal volume average particle size of 10-12 μm, was used.

The volume average particle size of the toner are measured in the following manner:

A Coalter Counter TA-II (Coalter Corporation) is used. To the counter, an interface (Nikkaki Kabushiki Kaisha, Japan) outputting a number average distribution and a volume average distribution, and CX-1 personal computer (Canon Inc. Japan) are connected. Using an electrolyte (first class natrium chloride), 1% NaCl water solution is prepared.

To the electrolyte solution (100-150 ml), 0.1-5 ml of a surface active agent (dispersing agent) (preferably alkylbenzene sulfonate) is added. Further, 2-20 mg of the material to be tested is added thereto.

The electrolyte suspending the material is subjected to the ultrasonic dispersing treatment for approximately 1-3 min. Using an aperture of 100 micrometers, the particle size distribution in the range of 2-40 micrometers is measured using the counter TA-II to obtain the volume distribution.

From the volume distribution obtained, the volume average particle size of the material is obtained.

Figure 7:
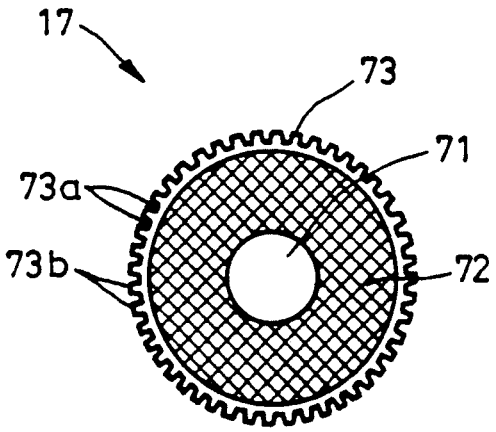
FIG. 7 is a diagram illustrating another embodiment of the present invention.

FIG. 7 is a side view showing an elastic roller of a developing apparatus according to another embodiment of the present invention. The present embodiment has a feature in using an elastic roller 17 comprising a rubber elastic layer 72 made of a foam member cylindrically bonded and coated on a core member 71 made of metal, and a rubber skin layer 73 made of a rubber material, such as urethane rubber, silicone rubber or the like, provided on the elastic layer 72.

As shown in FIG. 7, recesses 73*a* and projections 73*b*, contacting the developing sleeve 3, extending in the longitudinal direction (axial direction) of the roller 17 are formed in the circumferential direction on the surface of the rubber skin layer 73 of the elastic roller 17. If the number of the projections 73*b* (the projections contacting the developing sleeve 3) per unit length in the circumferential direction (the direction of rotation) of the elastic roller 17 is represented by N/mm, the removal of particles of the toner 6 remaining on the developing sleeve 3 and the supply of new particles of the toner 6 to the developing sleeve 3 can be stably performed within the range satisfying the conditional expression (1). Moreover, an excellent image not having deterioration in picture quality due to development can be obtained, providing the same excellent effects as in the preceding embodiment.

Figure 8:
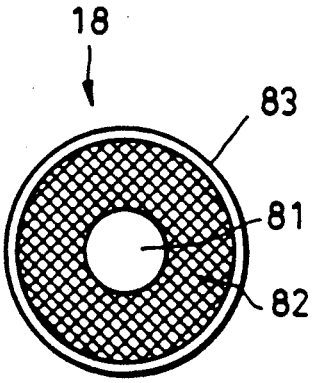
FIG. 8 is a diagram illustrating still another embodiment of the present invention.
Figure 9:
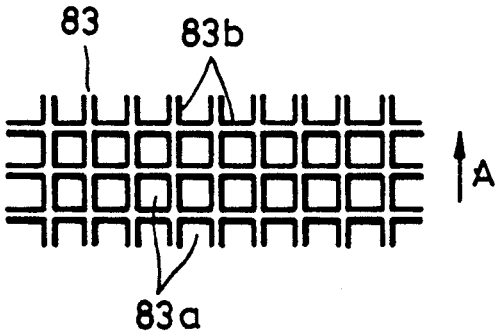
FIG. 9 is an enlarged view of the surface of the roller shown in FIG. 8.

FIG. 8 is a side view showing an elastic roller of a developing apparatus according to still another embodiment of the present invention. FIG. 9 is a plan view showing a mesh member provided in the elastic roller shown in FIG. 8.

As shown in FIG. 8, the present embodiment has a feature in using an elastic roller 18 comprising a rubber elastic layer 82 made of a foam member cylindrically bonded and coated on a core member 81 made of metal, and a mesh member 83 made of Nylon-Teflon ®, teflon ®, PTFE or the like, provided on the elastic layer 82.

As shown in FIG. 9, the mesh member 83 has the form of a grid whose frames are parallel and perpendicular to the axis of the elastic roller 18 rotating in the direction of arrow A, and is provided on the elastic layer 82. Recesses comprising vacant portions 83*a* and projections comprising grid portions 83*b* of the mesh member 83 are formed along the circumferential direction on the surface of the elastic roller 18. The grid portions 83*b* of the mesh member 83 have the same function as the cell walls 52*b* in the above-described elastic roller 15 having the foam structure.

Also in the above-described elastic roller 18, if the number of the grid portions 83*b* (the grid portions contacting the developing sleeve 3) per unit length in the circumferential direction (the direction of rotation) of the roller is N/mm, the removal of particles of the toner 6 remaining on the developing sleeve 3 and the supply of new particles of the toner 6 to the developing sleeve 3 can be stably performed within the range satisfying the conditional expression (1). Furthermore, an excellent image not having deterioration in picture quality due to development can be obtained, providing the same excellent effects as in the preceding embodiments.

Furthermore, by forming the mesh member 83 with a material having a low coefficient of friction relative to the developing sleeve 3, the present embodiment also provides the effect of reducing the torque of a driving source of the developing apparatus for providing driving force for the developing sleeve 3 or the like.

Although, in the above-described embodiments, a bias voltage is not applied to the elastic roller, the elastic roller may be semiconductive, and a bias voltage may be applied, for example, in order to remove particles of the toner 6 remaining on the developing sleeve 3. A DC voltage may be used as the developing bias voltage.

What is claimed is:

1. A developing apparatus for developing an electrostatic latent image formed on an image bearing member, said apparatus comprising:

a developer container for receiving a one-component nonmagnetic developer;

a rotatable developer carrying member for carrying the one-component nonmagnetic developer and for conveying the one-component nonmagnetic developer from said developer container to a developing area for developing the electrostatic latent image;

a developer regulating member for regulating the thickness of a layer of the one-component nonmagnetic developer conveyed to the developing area by said rotatable developer carrying member; and an elastic rotatable member disposed within said developer container for forming a nip portion with said rotatable developer carrying member at a position upstream from said developer regulating member with respect to the direction of rotation of said developer carrying member, said elastic rotatable member comprising a surface having projections and recesses thereon, and said elastic rotatable member rotating in the same direction as said developer carrying member, wherein a circumferential speed $V_1$ (mm/sec) of said rotatable developer carrying member, a circumferential speed $V_2$ (mm/sec) of said elastic rotatable member, a width d (mm) of the nip portion between said rotatable developer carrying member and said elastic rotatable member, and a number N (/mm) per unit length of the projections on the surface of said elastic rotatable member in the direction of rotation of said elastic rotatable member are set so as to satisfy the relationship:

$$V_2 \geqq V_1/4,$$

and $$6 \leqq N \times d \times (V_1 + V_2)/V_1 \leqq 40.$$

2. A developing apparatus according to claim 1, wherein said elastic rotatable member comprises a surface layer comprising a foam elastic member having cells as said recesses, and cell walls as said projections.

3. A developing apparatus according to claim 2, wherein said foam elastic member comprises a rubber elastic member.

4. A developing apparatus according to claim 1, wherein the surface of said elastic rotatable member comprises a mesh.

5. A developing apparatus according to claim 1, wherein said elastic rotatable member comprises an elastic skin layer having said projections and said recesses coated on a foam elastic member.

6. A developing apparatus according to any one of claims 1-5, wherein said developer regulating member regulates the thickness of the layer of the one-component developer to a thickness smaller than a minimum gap between the image bearing member and said rotatable developer carrying member at the developing area, and wherein said rotatable developer carrying member triboelectrically charges the developer to a polarity for developing the electrostatic latent image.

7. A developing apparatus according to claim 6, further comprising a power supply for applying an oscillating bias voltage to said rotatable developer carrying member.

8. A developing apparatus according to claim 6, wherein the width of the nip portion is between 1 and 8 mm.

9. A developing apparatus for developing an electrostatic latent image formed on an image bearing member, said apparatus comprising:

a developer container for receiving a one-component nonmagnetic developer;

a rotatable developer carrying member for carrying the one-component nonmagnetic developer and conveying the one-component nonmagnetic developer from said developer container to a developing area for developing the electrostatic latent image, said rotatable developer carrying member triboelectrically charging the one-component nonmagnetic developer to a polarity for developing the electrostatic latent image;

a developer regulating member contacting said rotatable developer carrying member for regulating the thickness of a layer of the one-component nonmagnetic developer conveyed to the developing area by said rotatable developer carrying member; and an elastic rotatable member disposed within said developer container for forming a nip portion with said rotatable developer carrying member at a position upstream from said developer regulating member with respect to the direction of rotation of said rotatable developer carrying member, said elastic rotatable member comprising a surface having projections and recesses thereon, and said elastic rotatable member rotating in the same direction as said developer carrying member, wherein a circumferential speed $V_1$ (mm/sec) of said rotatable developer carrying member, a circumferential speed $V_2$ (mm/sec) of said elastic rotatable member, a width d (mm) of the nip portion between said rotatable developer carrying member and said elastic rotatable member, and a number N (/mm) per unit length of the projections on the surface of said elastic rotatable member in the direction of rotation of said elastic rotatable member are set so as to satisfy the relationship:

$$V_2 \geqq V_1/4,$$

and $$6 \leqq N \times d \times (V_1 + V_2)/V_1 \leqq 40.$$

10. A developing apparatus according to claim 9, wherein said elastic rotatable member comprises a surface layer comprising a foam rubber elastic member having cells as said recesses, and cell walls as said projections.

11. A developing apparatus according to claim 9, wherein the surface of said elastic rotatable member comprises a mesh.

12. A developing apparatus according to claim 9, wherein said elastic rotatable member comprises an elastic skin layer having said projections and said recesses coated on a foam rubber elastic member.

13. A developing apparatus according to any one of claims 9–12, wherein said developer regulating member comprises an elastic blade, and regulates the thickness of the layer of the one-component developer to a thickness smaller than a minimum gap between the image bearing member and said rotatable developer carrying member at the developing area.

14. A developing apparatus according to claim 13, further comprising a power supply for applying an oscillating bias voltage to the developer carrying member.

15. A developing apparatus according to claim 13, wherein the width of the nip portion is between 1 and 8 mm.

* * * * *

UNITED STATES PATENT AND TRADEMARK OFFICE

CERTIFICATE OF CORRECTION

PATENT NO. : 5,086,728

DATED : February 11, 1992

INVENTOR(S) : MASAHIDE KINOSHITA

It is certified that error appears in the above-identified patent and that said Letters Patent is hereby corrected as shown below:

IN [57] ABSTRACT

Line 13, "$V_2 \geqq_{V1}/4$," should read --$V_2 \geqq V_1/4$,--.

COLUMN 1

Line 25, "one" should read --one- --.

COLUMN 2

Line 44, "an" (second occurrence) should read --a--.

COLUMN 7

Line 30, "(form" should read --(foam--.

COLUMN 8

Line 14, "direction" should read --directions--.

COLUMN 14

Line 39, "are" should read --is--.

UNITED STATES PATENT AND TRADEMARK OFFICE

CERTIFICATE OF CORRECTION

PATENT NO. : 5,086,728

DATED : February 11, 1992

INVENTOR(S) : MASAHIDE KINOSHITA

It is certified that error appears in the above-identified patent and that said Letters Patent is hereby corrected as shown below:

COLUMN 15

Line 27, "Nylon-Teflon®, te-" should read --Nylon®, Teflon®,--.
Line 28, "flon®," should be deleted.

Signed and Sealed this

Third Day of August, 1993

*Attest:*

Michael K. Kirk

MICHAEL K. KIRK

*Attesting Officer*

*Acting Commissioner of Patents and Trademarks*